US006430853B1

(12) United States Patent
Choi

(10) Patent No.: US 6,430,853 B1
(45) Date of Patent: Aug. 13, 2002

(54) LINKING APPARATUS OF EMERGENCY EXIT SIGNAL CASING

(75) Inventor: Man-Hyung Choi, Kyoungkee-do (KR)

(73) Assignee: Dong Bang Electronic Industrial Co., Ltd., Seoul (KR)

( * ) Notice: Subject to any disclaimer, the term of this patent is extended or adjusted under 35 U.S.C. 154(b) by 0 days.

(21) Appl. No.: 09/265,886

(22) Filed: Mar. 11, 1999

(30) Foreign Application Priority Data

Mar. 12, 1998 (KR) ..... 98-8318

(51) Int. Cl.[7] ..... G09F 13/04
(52) U.S. Cl. ..... 40/570; 40/564
(58) Field of Search ..... 40/564, 570; 439/564, 439/546, 552, 554, 31; 362/368, 147

(56) References Cited

U.S. PATENT DOCUMENTS 3,402,494 A * 9/1968 Gray ..... 40/570
5,338,226 A * 8/1994 Gryce et al. ..... 439/546
5,428,912 A * 7/1995 Grondal et al. ..... 40/570
5,634,816 A * 6/1997 Ohtaka et al. ..... 439/546

* cited by examiner

*Primary Examiner*—Cassandra H. Davis
(74) *Attorney, Agent, or Firm*—Finnegan, Henderson, Farabow, Garrett, & Dunner, L.L.P.

(57) ABSTRACT

An emergency exit lighting apparatus comprises an emergency exit signal casing, and a mounting bracket mounted on a wall or a ceiling, wherein concave holes are formed in a diagonal direction to be extended to two punched linking holes at a center of one of top and side surfaces of the emergency exit signal casing, and an electric wire guiding hole is formed between the two linking holes. The emergency exit signal casing can be easily attached to the mounting bracket by bring rotated in a clockwise direction and easily detached therefrom by being rotated in an anti-clockwise direction.

6 Claims, 4 Drawing Sheets

LINKING APPARATUS OF EMERGENCY EXIT SIGNAL CASING

BACKGROUND OF THE INVENTION

1. Field of the Invention

The present invention relates to the linking apparatus of the emergency exit signal casing mounted on the ceiling or the wall for leading people safely to emergency exits in buildings in emergency situations. The linking apparatus of the emergency exit signal casing according to this invention is constructed to enable the users to easily attach the emergency exit signal casing to and detach from amounting bracket mounted on the ceiling or the wall.

2. Description of the Prior Art

According to the conventional emergency exit signal casing, the body of emergency exit signal casing is directly fastened to the wall or ceiling by bolts and nuts. Consequently it was very difficult to install the emergency exit signal casing on the ceiling or the wall according to the structure and the position of the ceiling or the wall, and many installation tools are needed.

What is worse is when we have to make a repair. It is indispensable to dismantle the whole emergency exit signal casing when the interior instruments of the exit signal casing are out of order. As a result it took a lot of time, tools and a difficult operation. We cannot fix the emergency exit signal casing at the very place where it was set up after repairing. That is, it was often impossible to reset the emergency exit signal casing to the same position according to the structure and materials of the ceiling. In a case where the emergency exit signal casing is installed on the wall instead of the ceiling, the same problem was occurred.

SUMMARY OF THE INVENTION

In order to solve such problems the inventor suggested a new linking apparatus of the emergency exit signal casing which enables the emergency exit signal casing to be easily attached to and detached from mounting bracket mounted on the ceiling or the wall, regardless of the structure, materials of the ceiling or the wall.

Specifically, the purpose of the present invention is to provide a linking apparatus of the emergency exit signal casing and the mounting bracket, wherein the linking apparatus is easily attached to or detached from the ceiling or the wall by rotating the emergency exit signal casing against the mounting bracket mounted on the ceiling or the wall. When the interior instruments of the emergency exit signal casing are out of order and the emergency exit signal casing needs to be repaired we have only to detach the exit casing from the mounting bracket mounted on the ceiling or the wall.

After being repaired, the emergency exit signal casing can be fixed to the mounting bracket mounted on the ceiling or the wall. Accordingly once the emergency exit is mounted on the ceiling or the wall, the emergency exit can be fixed to the same position after being repaired. The installation of the emergency exit needs to be changed, so the break will not be occurred on the ceiling or the wall.

DETAILED DESCRIPTION OF THE EMBODIMENT

Figure 1:
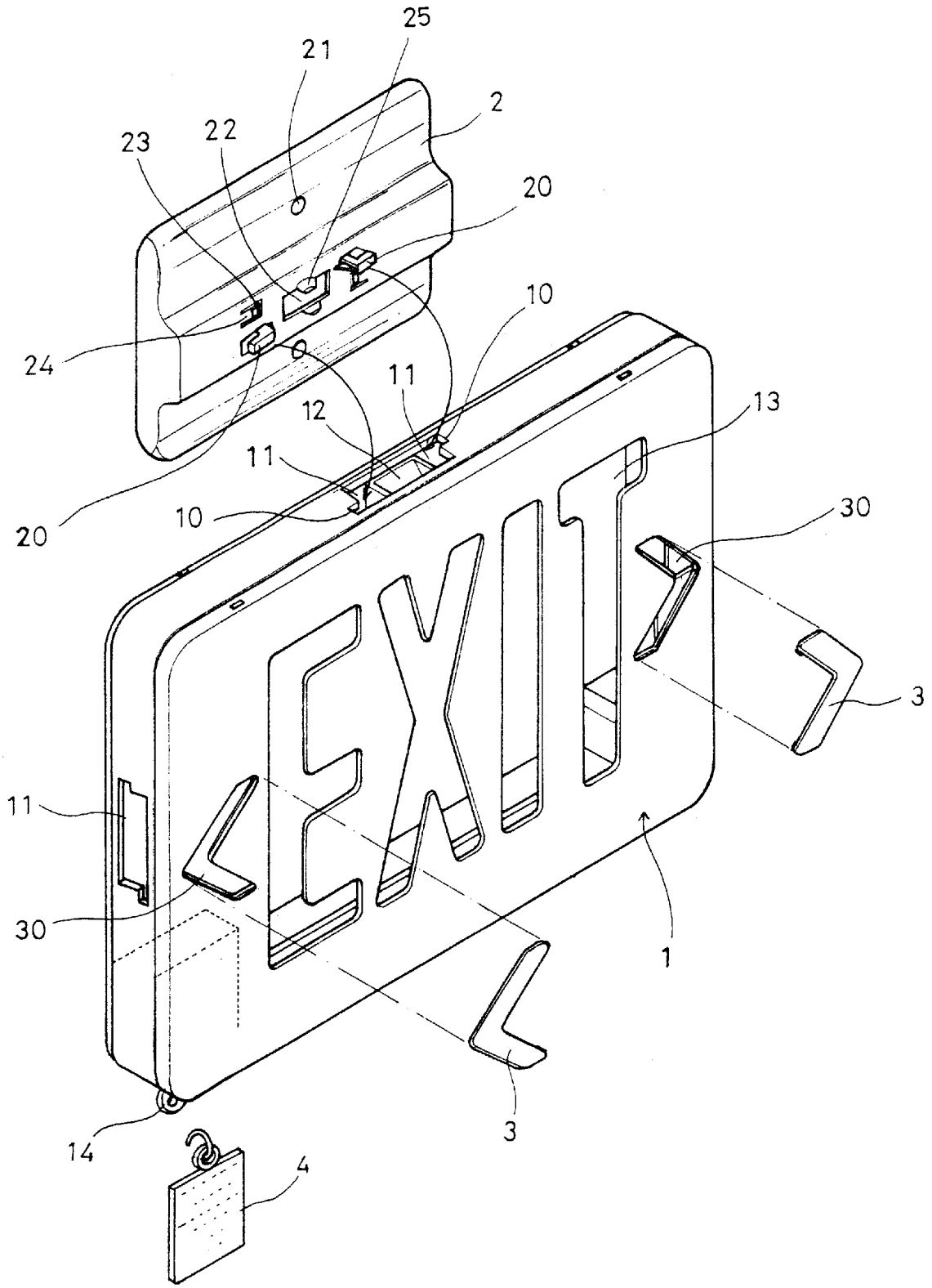
FIG. 1 is a perspective view showing the emergency exit signal casing and the mounting bracket which constitute the linking apparatus of the emergency exit signal casing according to the present invention.
Figure 2:
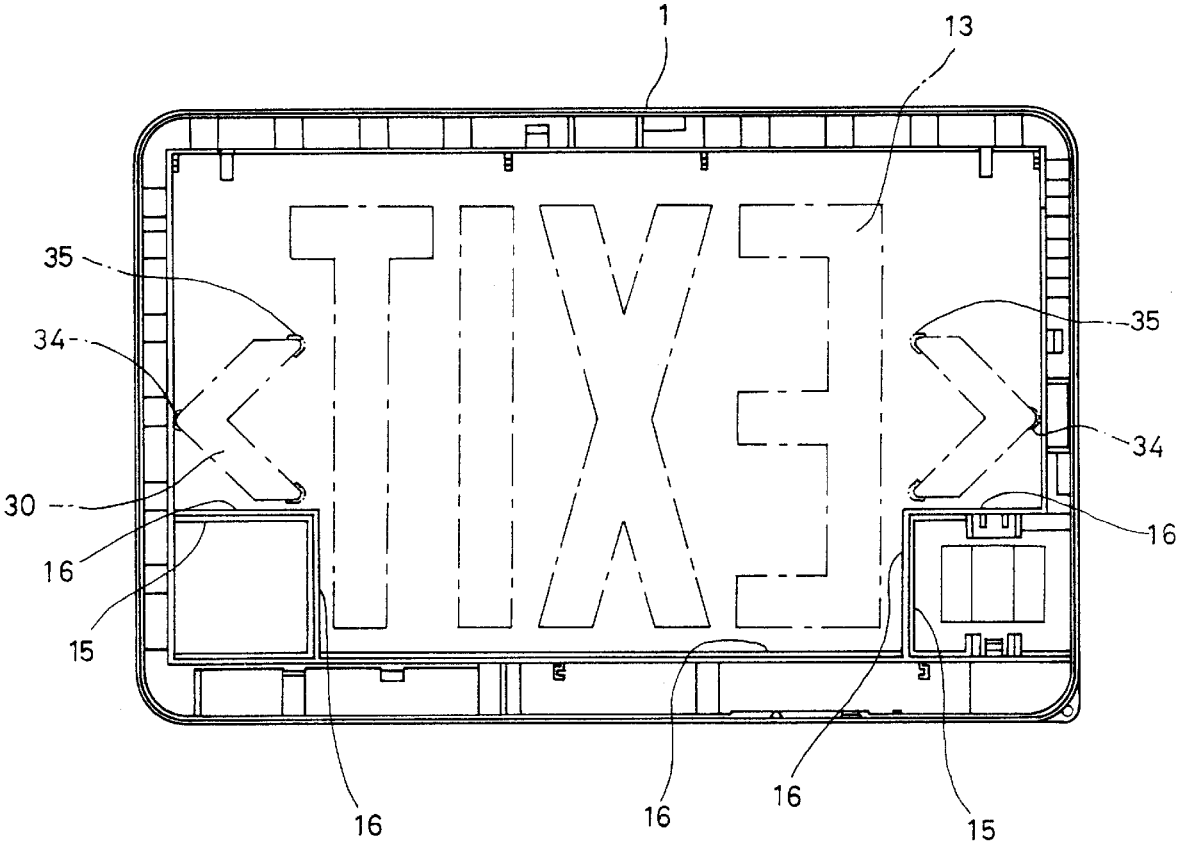
FIG. 2 is a rear view showing the interior of the emergency exit signal casing according to the present invention.

To accomplish these purposes, the structure of this invention will be more clear with reference to the following descriptions and the accompanying drawings.

The linking apparatus of the protrusion type emergency exit signal casing comprises of the emergency exit signal casing (1) and the mounting bracket (2) (which is to be mounted on the ceiling or wall), wherein fastening claws (20, 20) are situated on the bottom surface of the mounting bracket (2) and are diagonally placed with protrusion type and are to be fitted with concave holes (10,10).

Concave holes (10, 10) are in the diagonal direction to each other placed extendedly from the linking holes (11, 11) which are punched on the top or side surface of the emergency exit signal casing (1). When the emergency exit signal casing (1) is rotated in the clockwise direction against the mounting bracket (2), emergency exit signal casing (1) can be easily fastened to the mounting bracket (2) in the state that the centering mounts (25, 25) serve as an axis of rotation. If the emergency exit signal casing (1) is to be rotated in the reverse direction, it can be easily detached from the mounting bracket (2).

The fastening claws (20) are positioned in the diagonal direction of the bottom surface of the mounting bracket (2) and are positioned in a way that the fastening claws (20) can be inserted into the concave holes (10) when the emergency exit signal casing (1) is obliquely attached to the mounting bracket (2). In the linking apparatus, between two linking holes (11, 11) of the emergency exit signal casing (1), a electric wire guiding hole (12) is formed to pass the electric wire through itself.

Furthermore, in the linking apparatus of the emergency exit signal casing mounted on the ceiling or wall, the direction indicator holes (30) are to be punched in both the left and the right sides of the EXIT letters (13) on the front and rear surface of the emergency exit signal casing (1).

The linking apparatus of the exit case is set that one direction indicator hole (30) is to be open and the other side to be covered with the detachable direction arrow (3).

In the linking apparatus of the emergency exit signal casing according to the present invention, the direction indicator hole (30) comprises of a fastening hole (34) at the front end of the direction indicator hole and arrival parts (35) at rear ends.

Figure 4:
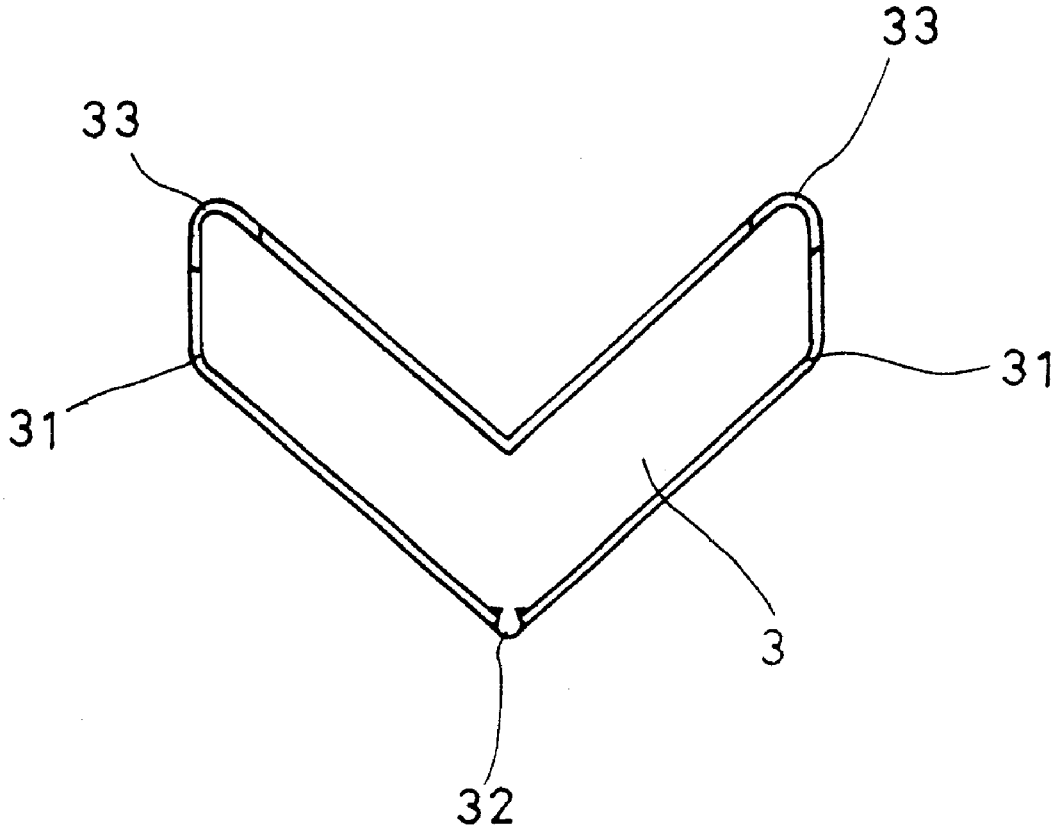
FIG. 4 is a rear view showing a detachable direction arrow according to the present invention.

In the linking apparatus of the emergency exit signal casing according to the present invention, the detachable direction arrow (3) comprises of the contact edge (31) projectingly formed at the peripheral edge of the detachable direction arrow, the fixing protrusion (32) at the front end and the snap parts (33) at both rear ends as illustrated in the FIG. 4.

Figure 3:
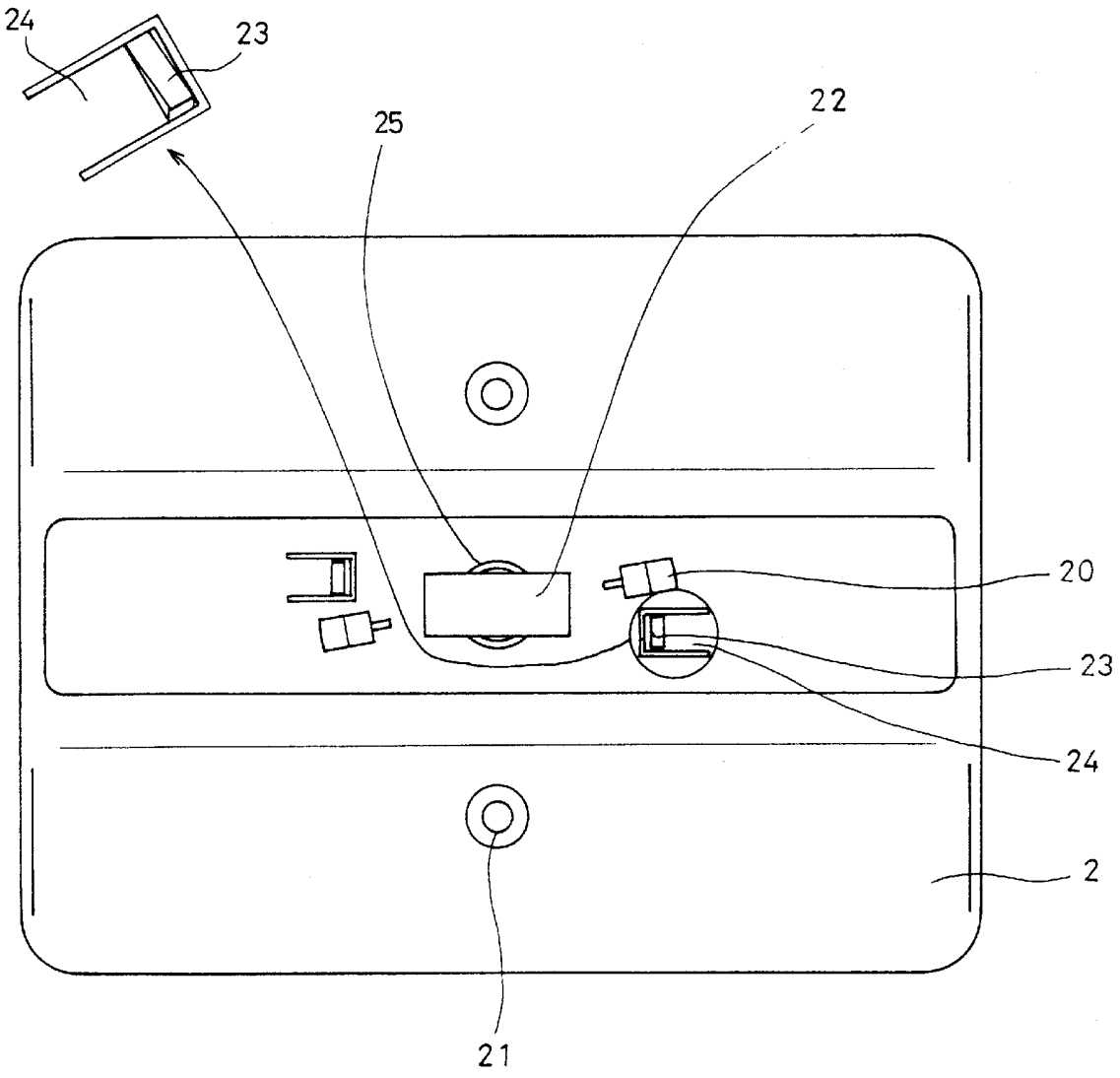
FIG. 3 is a plan view showing the mounting bracket according to the present invention.

In the linking apparatus of the emergency exit signal casing according to the present invention, the mounting bracket (2) comprises of the electric wire guiding hole (22) which has a rectangular form at the center of the bottom surface of the mounting bracket (2), centering mounts (25) formed to be projected at positions opposite to each other at the peripheral part of the electric wire guiding hole (22) (referred to the FIG. 3), hooked fastening claws (20) formed to be projected at the positions opposite to each other in a diagonal direction on both the left and right sides of the electric wire guiding hole (22) and spring portions (24) next to the fastening claws as illustrated in the FIG. 3. On the spring portion (24), a protrusion (23) is formed with an oblique protrusion form.

The linking apparatus provides mounting bracket's hooked fastening claws (20, 20) which are inserted into the concave holes (10, 10) formed in the diagonal direction of the linking hole (11) of the emergency exit signal casing (1), and when the exit signal casing (1) is rotated in a clockwise direction against the bracket (2) it is easily fastened to the mounting bracket (2). If the emergency exit signal casing (1) is to be rotated in the anti-clockwise direction, it is easily detached from the mounting bracket (2).

When the centering mounts (25) of the mounting bracket (2) is inserted into the electric wire guiding hole (12) and the exit casing (1) rotates in the clockwise direction or the anti-clockwise direction against the mounting bracket (2), the centering mount (25) will be the axis of rotation. At a lower edge of exit casing (1), there is a hole (14) for a check list (4) which is to be hung on. The result of the check will be listed on the check list (4).

Partition plates (15) are at the lower corner of exit case's inner part. The reflection plates (16) are placed on the partition plates (15, 15) and on the lower surface between two partition plates (15, 15). The advantage of the present invention as described above is explained more concretely hereinafter.

As described in the FIG. 1 which corresponds to the perspective view of the present invention, the mounting bracket (2) comprises of the fixing screw inserting holes (21, 21) for fixing the screws (it isn't shown in this figure). The screws are inserted into the wall or ceiling and then the mounting bracket (2) is fixed to the ceiling or wall.

Then the electric wire from the ceiling is guided into the electric wire guiding hole (22) punched at the center of the mounting bracket (2) mounted on the ceiling or wall as described beforehand.

After the bracket (2) is mounted on the ceiling or on the wall as described before, the emergency exit signal casing (1) in which the interior instruments have been installed is fixed to the bracket (2). Then the electric wire will be guided through the electric wire guiding hole (12) punched on the top surface of the emergency exit signal casing, via the guide hole (22) of the mounting bracket (2). The electric wire can be connected to the interior instrument.

Then hooked fastened claws (20) formed projectingly in the diagonal direction on the mounting bracket (2) are inserted into the concave holes (10) formed in the diagonal direction at the linking holes (11) of the emergency exit signal casing (1). A pair of centering mounts (25, 25) which are protruded at opposite positions to each other at the peripheral edge of the electric wire guiding hole (22) punched on the mounting bracket (2), are also inserted into the exit casing's electric wire guiding hole (12).

After the hooked fastening claws (20, 20) are inserted into the concave holes (10) extended from the linking holes (11, 11), the emergency exit signal casing (1) is rotated in a clockwise direction. At this time, the centering mounts (25), which has been inserted into the electric wire guiding hole (12), serves as an axis of rotation, to avoid the emergency exit signal casing of being shaken when it is rotated. As described before, when the emergency case is rotated, the hooked fastening claws (20, 20) slide into the inner part of emergency exit signal casing (1) to fix the emergency exit signal casing (1).

The protrusion (23) is slantingly formed on the spring portion (24) which is on around the hooked fastening claw (20) in the mounting bracket (2). When the emergency exit signal casing (1) is turned against the mounting bracket (2) with the protrusion (23) adhered closely to the top surface of the emergency exit signal casing (1), the emergency exit signal casing (1) is inserted slidely into the mounting bracket (2) with the spring portion (24) being pressed by the top surface of the emergency exit signal casing (1). Once the protrusion (23) reaches the concave hole (10), the spring portion (24) is sprung by elasticity and the protrusion (23) is hooked in the concave hole (10). If the emergency exit signal casing (1) is turned against the mounting bracket (2) after the claw (20) is inserted into the concave hole (10), the emergency exit signal casing (1) is held to the bracket (2) with the fastening claw (20) attached closely to the inside of the emergency exit signal casing (1). The protrusion (23) formed on the spring portion (24) is inserted into the concave hole (10) and is hooked in the concave hole (10). As a result, the exit casing (1) is firmly fixed to the mounting bracket (2).

The protrusion (23) formed integrally on the spring portion is tapered in a positive direction, that is, to the fastening claw (20) as illustrated in FIG. 3. Consequently when the exit casing (1) is rotated in a clockwise direction, the spring portion (24) is automatically pressed downwardly by the top surface of the exit signal casing (1). Moreover, as the rotation is over, the cliff made at the other end of the protrusion (23) is hooked by the concave hole (10) so that the exit case (1) can be locked to the bracket (2) On both the left and the right sides of the front surface and the rear surface of exit case (1), the direction indicator holes (30) are formed in order to indicate the direction to which the EXIT letters (13) intend to lead people. Therefore before or after the installation of the emergency exit on the ceiling or the wall, we can easily fit the detachable direction arrow (3) to the direction indicator hole (30) which is not in the real direction of the emergency exit. The unnecessary direction indicator hole (30) is veiled by the detachable direction arrow (3) so that the direction indicator hole (30) shows only the direction wanted.

To the contrary, after two direction indicator holes (30, 30) punched on both left and the right surface of the emergency exit signal casing (1) have been fitted by the detachable direction arrows (3, 3), a detachable direction arrow (3) inserted into a direction indicator hole (30) of the intended direction may be detached and then same advantage as above will be expected.

In the linking apparatus of the emergency exit signal casing according to the present invention, two direction indicator holes are formed in the left and right sides of the EXIT letters (13) in order to indicate the direction of the exit, so that the intended direction may be selected according to the installed position. Accordingly the setting of the emergency exit is simplified.

When the detachable direction arrow (3) is fitted slidely to the direction indicator hole (30), the rear ends of the detachable direction arrow (3) is firstly pressed to the direction indicator hole (30) at a slant. When the snap parts (33) of the detachable direction arrow (3) are fitted into the arrival parts (35) provided at the rear ends of the direction indicator hole (30) and the front ends of the detachable direction arrow (3) is pressed, then the fixing protrusion (32) at front end of detachable direction arrow (3) is inserted into the fastening hole (34) of the direction indicator hole (30). The edge (31) of the detachable direction arrow (3)is contacted and fixed to peripheral edge of the direction indicator hole (30)

To the contrary, when the detachable direction arrow (3) is detached from direction indicator hole (30), the front end of detachable direction arrow (3) is pressed from the interior and then the fixing protrusion (32) is detached from the fastening hole (34). As a result, detachable direction arrow (3) can be simply detached from the direction indicator hole (30) of the emergency exit signal casing (1).

At the lower end of the corner of the exit signal casing (1) is a check list hole (14) where the check list (4) is to be hung. On the check list is listed every checking result to show whether the emergency exit can be operating soundly.

At the two lower corners of interior of the exit case (1) is a partition (15). Inside the partition (15), the transformer is mounted. On the outer surface of the partition (15) and on the lower bottom surface of exit case (1) between the partitions (15, 15), the reflection plate (16) is covered. Light emitted from interior light which lights the EXIT letters (13) is reflected by the reflection plate (16) toward the inner part of the exit case in order to intensify the luminance of the EXIT letters (13).

As described before, the invention related to this linking apparatus of emergency exit signal casing enables the users to easily attach the emergency exit signal casing (1) to and detach from the bracket (2) mounted on the ceiling or the wall only by simply rotating emergency exit signal casing in a clockwise or anti-clockwise direction. Therefore the efficiency of operation can be guaranteed.

What is claimed is:

1. An emergency lighting apparatus comprising:

an emergency signal casing; and a mounting bracket mounted on a wall or a ceiling, wherein the emergency signal casing is attached to the mounting bracket by being rotated in a first rotational direction and is detached from the mounting bracket by being rotated in an second rotational direction, and wherein first holes are formed in a diagonal direction to be extended to two linking holes at a center of one of a top surface or a side surface of the emergency signal casing, and an electric wire guiding hole is formed between the two linking holes.

2. An emergency lighting apparatus comprising:

an emergency signal casing; and a mounting bracket mounted on a wall or a ceiling, wherein the emergency signal casing is attached to the mounting bracket by being rotated in a first rotational direction and is detached from the mounting bracket by being rotated in a second rotational direction, and wherein a first partition connects walls forming a first interior lower corner of the emergency signal casing, a second partition connects walls forming a second interior lower corner of the emergency signal casing, a first reflection plate is formed on an outside surface of the first and second partitions, and a second reflection plate is formed on an interior bottom surface between the first and second partitions of the emergency signal casing.

3. An emergency lighting apparatus comprising:

an emergency signal casing; and a mounting bracket mounted on a wall or a ceiling, wherein the emergency signal casing is attached to the mounting bracket by being rotated in a first rotational direction and is detached from the mounting bracket by being rotated in a second rotational direction, and wherein an electric wire guiding hole for guiding and inserting an electric wire is formed at a center of a bottom surface of the mounting bracket and two centering mounts opposite to each other are formed at peripheral parts of the electric wire guiding hole.

4. The apparatus of claim 3 wherein around said electric wire guiding hole, two hooked fastening claws are formed to be projected at the opposite position to each other in diagonal direction and two spring portions are formed nearby said fastening claws in state that at each end portion of said spring portions is mounted an oblique protrusion.

5. The apparatus according to claim 4, wherein when said hooked fastening claws are inserted into first holes formed in linking holes of the emergency signal casing, the emergency signal casing is fastened to the mounting bracket by rotating in the first rotational direction and detached from the mounting bracket by rotating in the second rotational direction.

6. The apparatus according to claim 3, wherein when said centering mounts of the mounting bracket are inserted into the electric wire guiding hole of the emergency signal casing, wherein a midpoint of said centering mounts serves as an axis of rotation for rotation of the signal casing.

* * * * *